US005893553A

United States Patent [19]

Pinkous

[11] Patent Number: 5,893,553

[45] Date of Patent: Apr. 13, 1999

[54] PORTABLE C-CLAMP WITH NON-ROTATABLE CLAMPING PAD MEANS

[76] Inventor: Stephen L. Pinkous, 26 W. 033 Thomas Rd., Wheaton, Ill. 60187

[21] Appl. No.: 08/953,500

[22] Filed: Oct. 17, 1997

[51] Int. Cl.[6] ..... B25B 5/10

[52] U.S. Cl. ..... 269/249; 269/143; 29/257

[58] Field of Search ..... 269/249, 143, 269/250, 105, 121, 271; 29/256, 257

[56] References Cited

U.S. PATENT DOCUMENTS

| | | | |
|---|---|---|---|
| 809,882 | 1/1906 | Wrigley | 269/249 |
| 1,497,107 | 6/1924 | Lasell | 269/249 |
| 2,236,913 | 4/1941 | Merrill | 269/249 |
| 2,952,283 | 9/1960 | Chandler | 269/143 |
| 3,626,497 | 12/1971 | Lambert | 269/249 |
| 4,234,176 | 11/1980 | Goff et al. | 269/249 |
| 4,962,918 | 10/1990 | Yang | 269/249 |
| 5,135,209 | 8/1992 | Penny | 269/249 |
| 5,427,364 | 6/1995 | Zborschil | 269/249 |

*Primary Examiner*—David A. Scherbel
*Assistant Examiner*—Lee Wilson
*Attorney, Agent, or Firm*—Hill & Simpson

[57] ABSTRACT

A C-clamp device has a blocking bar detachably secured to the upper pad to prevent rotation of the pad and has a swivel pad on the lower anvil means for engagement with the clamped article.

5 Claims, 1 Drawing Sheet

PORTABLE C-CLAMP WITH NON-ROTATABLE CLAMPING PAD MEANS

BACKGROUND OF THE INVENTION

1. Field of the Invention

This invention relates generally to a device, usually of some rigid material, for strengthening or supporting objects or fastening them together, for example, a C-clamp.

2. The Prior Art

The prior art is exemplified by an appliance with opposite sides or parts that may be adjusted or brought closer together to hold or compress something. A so-called bar clamp has a longitudinally extending bar which may be notched and grooved so that an anvil may be adjustably positioned along the length of the bar. At one end of the bar, there is an upstanding bracket through which a threaded rod extends in threaded relation therewith. The rod may be selectively rotated by turning a crank arm on one of the ends of the rod. At the opposite end of the rod, there is a pad which is also slidably supported by the bar. Thus, by turning the crank, the rod will threadedly advance or retract in the bracket, thereby correspondingly advancing or retracting the pad towards and/or away from the anvil so that objects may be held or clamped thereby.

In another form of prior art device, a C-clamp is provided wherein a body portion is made of a rigid material such as metal and is shaped in the form of the letter "C", i.e., it has a bight portion from which extend longitudinally spaced apart parallel arms disposed at right angles to the bight portion.

One of the arms has a threaded aperture through which extends a correspondingly threaded rod having an actuating lever on the free end thereof. The other of the arms has an anvil portion formed thereon against which a workpiece, or, a part to be held or clamped may be retained when engaged by the end of the threaded rod between the arms.

To enhance the engagement of the rod with the workpiece, there is oftentimes provided a pad so that the workpiece does not become deformed or otherwise damaged by the clamping or holding action. When such a pad is provided, it is sometimes retained on the end of the threaded rod by a ball joint, or simply by; some simple form of slip joint so that the pad may accommodate relative rotation with respect to the rod.

However, as clamping forces increase, the pad tends to rotate along with, or in unison with, the rod and the workpiece is apt to be marred or damaged during the course of the clamping or holding action. With the C-clamps available on the market today, many times the friction in the ball joint will be greater than the friction between the pad and the clamped workpiece, thereby causing the pad to move and loosen up, particularly on non-parallel objects.

SUMMARY OF THE PRESENT INVENTION

The present invention contemplates the utilization of a blocking bar which cannot turn past the body of the clamp and which is attached to the pad to prevent the pad from turning and losing its position vis a vis the body of the C-clamp. Further, the blocking bar and pad are interconnected by a separable threaded joint, for example, a nut may be welded to the pad, so that selectively sized blocking bars may be employed, thereby to accommodate placing the pad inside the workpiece, or part, being clamped or held, if such action be necessary.

Further, the present invention contemplates the utilization of a ball jointed pad on the anvil, thereby enhancing the clamping function with uneven surfaces.

DESCRIPTION OF THE PREFERRED EMBODIMENTS

Figure 1:
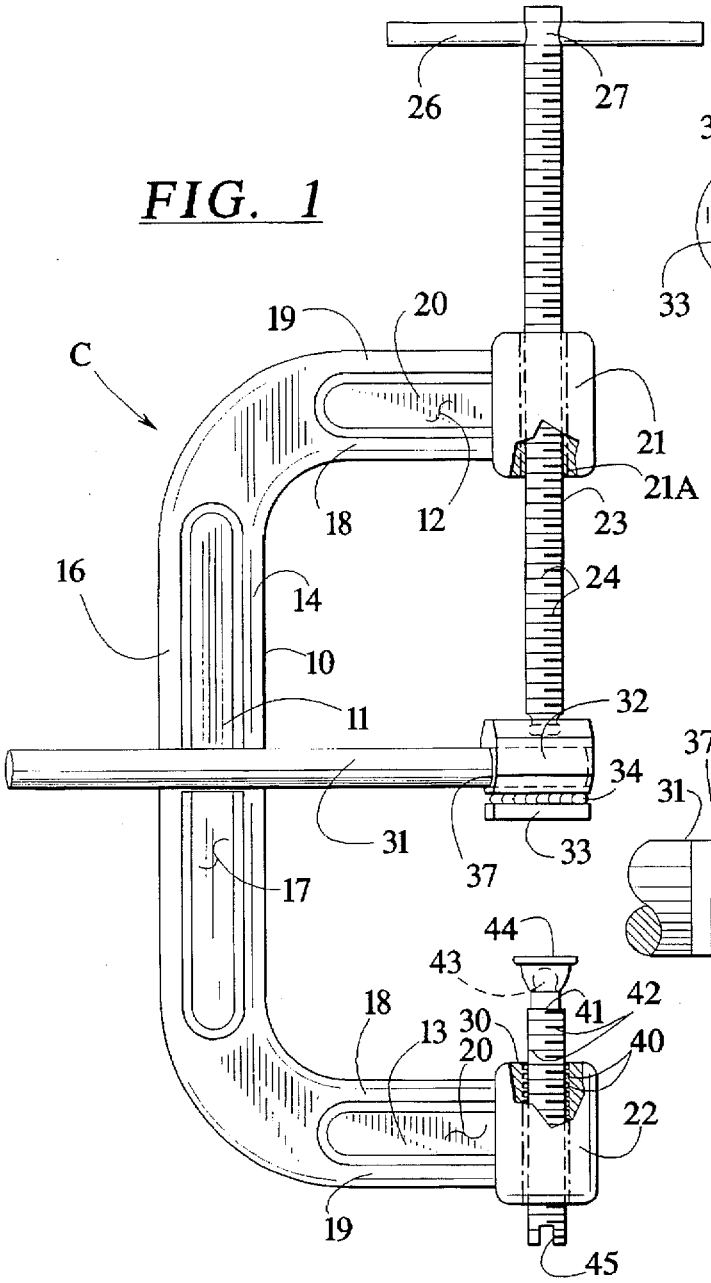
FIG. 1 is an elevational view showing a C-clamp incorporating the blocking bar features and ball jointed anvil pad feature provided in accordance with the principles of the present invention.

Referring to FIG. 1 of the drawings, there is shown an exemplary form of a C-Clamp embodying the principles of the present invention designated generally by the reference sign "C." The device C has a body portion 10 made of a rigid material such as metal, for example, steel. The device C is formed in the shape or configuration of the letter "C" i.e., the body portion 10 has a bight portion 11 from which extend two longitudinally spaced apart parallel arms 12 and 13, respectively. The arms 12 and 13 are disposed at right angles to the bight portion 11.

In the exemplary form of the device C shown in the drawings, the strength and rigidity of the device is enhanced by forming the bight portion 11 with inner flanges 14 and outer flanges 16 and with a lightening recess 17 therebetween, it being understood that the device C is symmetrically formed and shaped so that each of the front and rear faces of the device C is essentially the same.

In like manner, each of the arms 12 and 13 is also flanged with an inner flange 18 and an outer flange 19 with a lightening recess 20 therebetween.

At the end of the arm 12 there is formed a boss 21 and at the end of the arm 13 there is formed a boss 22. In order to develop the function of a clamping appliance, it is necessary to provide some means for effectively closing the jaw provided by the bosses 21 and 22, or in other words, to adjust or effectively bring the arms 12 and 13 closer together.

With the exemplary C-Clamp device C of the present disclosure, such clamping function is accomplished, first of all, by forming an internally threaded through aperture 21A in the boss 21. Next, an elongated rod 23 is provided having an externally threaded surface 24 which is complemental with the internal threads of the boss 21 so that the rod 23 may be threadedly extended through the boss 21. It should be noted, of course, that the threaded opening 21A in the boss is disposed to extend longitudinally so that the rod 23 will be essentially parallel to the bight portion 11 and the end of the rod 23 will be moved longitudinally either closer to the boss 22 or farther away from the boss 22.

To enhance the rotatable adjustment of the rod 23, there is provided an actuating handle 26. The rod 23 has a connecting joint 27 for accommodating a slidable union with the handle 26, thereby permitting the user to selectively vary the torque leverage applied to the handle 26, which in turn rotatably adjusts the rod 23 in the boss 21.

As will be apparent, when the actuating handle 26 is engaged by the hand of the user and the rod 23 is axially advanced or retracted in the boss 21 in a longitudinal direction towards and away from the boss 22, the longitudinal dimension of the jaw formed by the bosses 21 and 22 is closed, thereby to effect a clamping and holding function.

In this regard, the boss 22 has a surface which forms an anvil 30 against which an article to be clamped or held may be seated. The anvil 30 confronts the end of the rod 21 and forms one side of the clamp.

In order to enhance the contact between the article to be clamped and the rod 21, it is customary in prior art practice to utilize a pad at the end of the rod 21. Such pad is usually affixed to the end of the rod by a ball joint or by some other form of slip joint so that relative rotation of the rod 21 and the pad is accommodated, at least under light, or no-load situations. However, as the rod 21 is axially advanced in a longitudinal direction towards the anvil 30 and the pad on the end of the rod 21 engages the clamped article more firmly, more and more clamping force is applied, the ball joint or slip joint is oftentimes rendered ineffective. When that happens, the pad starts to rotate with the rod 21.

With the C-clamp device of the prior art, the friction in the ball joint or slip joint at the end of the rod 21 will be greater than the friction between the pad and the clamped article thereby causing the pad to move and loosen up, particularly on non-parallel surfaces When using a C-clamp device of the prior art, the user sometimes inadvertently moves the body of the C-clamp device causing the interface with the anvil 30 to slip. Such slipping has detrimental consequences. First of all, the surface of the clamped article may be marred, or damaged. Secondly, the interface with the anvil 30 may be moved to a less tightened position.

Figure 5:
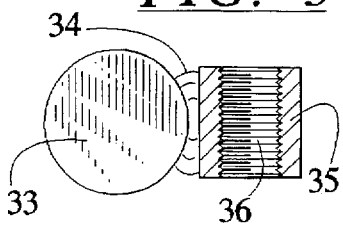
FIG. 5 is a partial sectional view taken on line V—V of FIG. 4.
Figure 3:
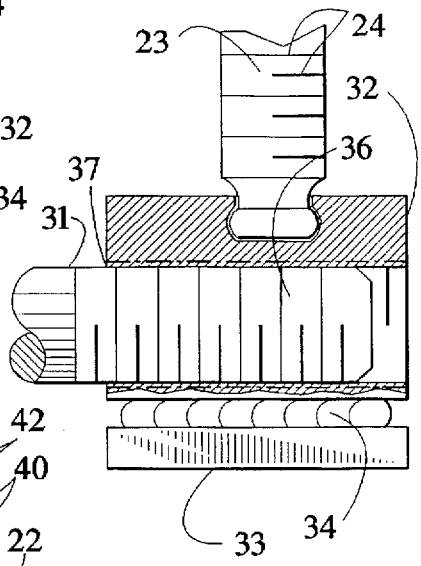
FIG. 3 is a view similar to that of FIG. 2, but with parts broken away to show in a cross-sectional view additional details of the sub-assembly forming the blocking bar arrangement of FIGS. 1 and 2.
Figure 4:
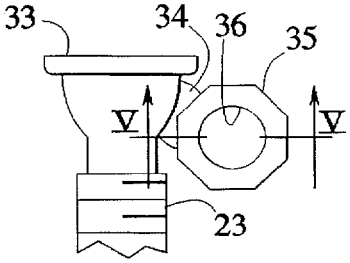
FIG. 4 is another form of joint which may be provided in practicing the invention.

In order to overcome such problems, it is contemplated by the present invention to provide a bar means 31 engageable with either a nut 35 (FIGS. 4 and 5) or a pad bracket 32 (FIGS. 1, 2 and 3) and to which a pad 33 is firmly assembled, for example, as by means of a weldment 34. The pad bracket 32 or the nut 35 is made of a strong rigid material, such as metal, and has formed therein an internally threaded opening or recess 36 disposed in a transverse direction relative to the normal longitudinal axis of the C-clamp device C.

The bar means 31 has a mating externally threaded end 37 which threadedly engages the internal threaded recess 36 in either the nut 35 or the bracket 32 so that the bar means 31 may be placed in firm assembly with the nut 35 or the pad bracket 32. The bar means 31 is sufficiently elongated in length so that it cannot be turned past the bight portion 11 of the body 10. By preventing the pad 33 from rotating, the position of the clamp device C on the article being clamped will not be lost.

Figure 2:
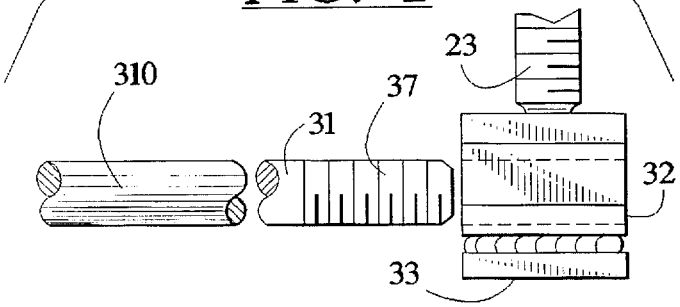
FIG. 2 is an exploded fragmentary view of the blocking bar feature of the present invention and depicting how different sized bars may be utilized selectively as provided in accordance with this invention.

In order to accommodate placing the pad 33 inside of an article to be clamped, it may be desirable to use a bar means 31 of a selectively shorter elongated length. That possibility is shown recognized in the broken view of FIG. 2 wherein the bar means 31 is depicted in broken form and wherein the left hand segment, using the orientation of FIG. 2, is marked with the reference sign 310, i.e., to illustrate the possible usage of bar means 31 of selectively different lengths.

The present invention further contemplates the provision of a ball jointed pad on the anvil 30 provided by the boss 22. Thus, the boss 22 is provided with an internally threaded recess 40 in which is turned a stud 41 having correspondingly externally threads 42. The upper end of the stud 41 carries a ball 43 on which a pad 44 is mounted for swivel movement. The lower end of the stud 41 has a groove 45 engageable with a screw driver for axial adjustment.

By virtue of such provision, when clamping objects without parallel surfaces the pad 44 can tip anyway it has to in order to meet perfectly with the uneven surface.

Further, with the ball jointed pad 44, possible movement of the article being clamped is accommodated within the ball joint 43 and not on the surface of the article.

Again, in those situations wherein the clamped article has some sort of lip or recession, the C-clamp C accommodates such situation by allowing the pad 44 to reach past the lip or recession.

Although various minor modifications might be suggested by those skilled in the art, it should be understood that I wish to embody within the scope of the patent warranted hereon all such modifications as reasonably and properly come with the scope of my contribution to the art.

I claim as my invention:

1. A portable C-clamp device comprising a body portion made of rigid material and formed in the configuration of the letter "C"

said body portion having a bight portion extending longitudinally and having longitudinally spaced apart arms extending laterally from said bight portion at right angles thereto, said arms forming a jaw for receiving an article to be clamped and held by said device, one of said arms having anvil means against which the article to be clamped and held is seated, the other of said arms having longitudinally movable adjustment means for closing said jaw by drawing selectively closer and away from said anvil means, thereby to effect clamping of the article, a pad having a slip joint connection on said adjustment means for engaging the article to be clamped and held, and bar means detachably connected to said pad, said bar means when so connected to said pad in functional relationship with said clamp being of sufficient length to engage said bight portion and thereby prevent rotation of said pad as it is longitudinally adjusted.

2. A portable C-clamp device as defined in claim 1 and further characterized by, said bar means comprising one of a plurality of bars of different length, but each said bar of different length being of sufficient length to engage said bight portion to prevent rotation of said pad as it is longitudinally adjusted, said pad and said bar means having a separable joint detachably fastening said bar means and said pad in firm assembly with one another throughout the life of said clamp.

3. A portable C-clamp device as defined in claim 1, and further characterized by:

said anvil means having a threaded adjustable mounted stud, and a ball jointed swivel pad mounted on said stud, thereby to afford a swivel pad engaging the article to be clamped.

4. A C-clamp device made of rigid material and shaped in the form of a letter "C" with a bight and upper and lower arms disposed at right angles to the bight to form a clamping jaw, jaw closing means comprising a threaded rotatable rod carried for adjustable movement in the upper arm and anvil means in the lower arm, whereby an article to be clamped is grasped therebetween, a pad rotatably carried on said rod having a bar means extending laterally so that it cannot move past the bight and will thereby prevent rotation of the pad, and a stud on the lower arm carrying a ball joint mounting a pad, thereby to afford a swivel pad on said anvil means for engagement with the clamped article.

5. A portable C-clamp device comprising a body portion made of rigid material and formed in the configuration of the letter "C,"

said body portion having a bight portion extending longitudinally and having longitudinally spaced apart arms extending laterally from said bight portion at right angles thereto, said arms forming a jaw for receiving an article to be clamped and held by said device, one of said arms having anvil means against which the article to be clamped and held is seated, the other of said arms having longitudinally movable adjustment means for closing said jaw by drawing selectively closer and away from said anvil for closing said jaw by drawing selectively closer and away from said anvil means, thereby to effect clamping of the article, a pad having a slip joint connection on said adjustment means for engaging the article to be clamped and held, and bar means detachably connected to said pad engageable with sigh bight portion to prevent rotation of said pad as it is longitudinally adjusted, said bar means and said pad have a mated threaded coupling affording selective attachment and detachment therebetween.

* * * * *